US010125962B2

(12) United States Patent
Chami

(10) Patent No.: US 10,125,962 B2
(45) Date of Patent: Nov. 13, 2018

(54) SECURITY LIGHT ASSEMBLY

(71) Applicant: MaxLite, Inc., West Caldwell, NJ (US)

(72) Inventor: Aymen Chami, Hackettstown, NJ (US)

(73) Assignee: MAXLITE INC., West Caldwell, NJ (US)

( * ) Notice: Subject to any disclaimer, the term of this patent is extended or adjusted under 35 U.S.C. 154(b) by 0 days.

(21) Appl. No.: 15/623,581

(22) Filed: Jun. 15, 2017

(65) Prior Publication Data

US 2017/0370565 A1 Dec. 28, 2017

Related U.S. Application Data

(60) Provisional application No. 62/353,105, filed on Jun. 22, 2016.

(51) Int. Cl.

| | |
|---|---|
| ***F21V 19/02*** | (2006.01) |
| ***F21V 23/04*** | (2006.01) |
| ***F21V 3/00*** | (2015.01) |
| ***F21V 17/02*** | (2006.01) |
| ***F21V 23/00*** | (2015.01) |
| ***F21V 19/00*** | (2006.01) |
| *F21S 8/00* | (2006.01) |
| *F21V 3/02* | (2006.01) |
| *F21V 19/04* | (2006.01) |
| *F21Y 115/10* | (2016.01) |

(52) U.S. Cl.

CPC ..... *F21V 23/0464* (2013.01); *F21V 3/00* (2013.01); *F21V 17/02* (2013.01); *F21V 19/003* (2013.01); *F21V 23/001* (2013.01); *F21V 23/003* (2013.01); *F21S 8/033* (2013.01); *F21V 3/02* (2013.01); *F21V 19/04* (2013.01); *F21Y 2115/10* (2016.08)

(58) Field of Classification Search

CPC .... F21S 2/005; F21S 8/036; F21S 8/04; F21S 9/022; F21S 8/033; F21V 17/002; F21V 23/001; F21V 23/003; F21V 23/0464; F21V 3/00; F21V 3/02; F21V 17/02; F21V 19/003; F21V 19/04

USPC ..... 362/285

See application file for complete search history.

(56) References Cited

U.S. PATENT DOCUMENTS 4,255,746 A * 3/1981 Johnson ..... F21V 33/0076 307/115
4,300,190 A * 11/1981 Mershon ..... F21V 21/02 362/147
4,403,278 A * 9/1983 Flood ..... F21S 8/06 362/368

(Continued)

*Primary Examiner* — Claude J Brown
(74) *Attorney, Agent, or Firm* — Budzyn IP Law, LLC

(57) ABSTRACT

A security light assembly that is mountable to a junction box and connectable to a power source via electrical cable comprises a housing comprising a base and a cover having a lens and a window portion. A sub-assembly comprises a first bracket attached to the base, a second bracket attached to the first bracket at a first location and selectively moveable about the first location between at least a first position and at least a second position that is different from the first position. When in the first position, the second bracket at least partially obstructs access to an access port, and when in the second position the second bracket does not at least partially obstruct access to the access port to enable connection of the electrical cable to the connection in the housing.

20 Claims, 6 Drawing Sheets

(56) References Cited

U.S. PATENT DOCUMENTS 5,446,629 A * 8/1995 Steiger ..... F21K 2/06 116/206
6,536,919 B1 * 3/2003 Johnson ..... F21V 17/107 248/222.11
9,869,457 B1 * 1/2018 Lin ..... F21S 8/033
9,897,269 B2 * 2/2018 Thomas ..... F21S 2/005
2010/0020551 A1 * 1/2010 Kay ..... F21V 21/34 362/365
2012/0268952 A1 * 10/2012 Newton ..... B23P 11/00 362/368
2013/0094225 A1 * 4/2013 Leichner ..... F21S 2/005 362/368
2013/0265783 A1 * 10/2013 Wang ..... F21V 29/006 362/374
2013/0329434 A1 * 12/2013 Packard ..... F21V 19/04 362/311.01
2014/0009945 A1 * 1/2014 Rapeanu ..... H05K 5/03 362/368
2014/0160738 A1 * 6/2014 Rozot ..... F21S 2/005 362/191
2014/0268828 A1 * 9/2014 Brown ..... F21V 17/002 362/373
2014/0301070 A1 * 10/2014 Oostdyk ..... F21V 29/505 362/231
2015/0167936 A1 * 6/2015 Yong ..... F21S 8/036 362/190
2015/0292723 A1 * 10/2015 Yu ..... F21V 29/76 362/147
2015/0338071 A1 * 11/2015 Feit ..... F21V 21/04 362/370
2016/0131346 A1 * 5/2016 Creasman ..... F21S 8/03 362/145
2016/0195669 A1 * 7/2016 Boulanger ..... H05B 33/0884 362/606
2016/0305637 A1 * 10/2016 Brunelli ..... F21V 21/28
2017/0102140 A1 * 4/2017 Bailey ..... F21V 29/74
2017/0125990 A1 * 5/2017 Smith ..... F21V 23/04
2017/0159925 A1 * 6/2017 Boomgaarden ..... F21V 29/71
2017/0227195 A1 * 8/2017 Feit ..... F21V 21/04
2017/0268736 A1 * 9/2017 Harpenau ..... F21S 8/043
2017/0299164 A1 * 10/2017 Mak ..... F21V 23/002

* cited by examiner

SECURITY LIGHT ASSEMBLY

FIELD OF THE INVENTION

The present invention relates to improvements to a security light assembly with solid-state lighting (SSL) technology and devices that can be used to easily replace already-installed security light assemblies.

BACKGROUND OF THE INVENTION

Security lights are ubiquitous to the point of hardly being noticeable. They are present inside and outside virtually every commercial building, including offices, shopping malls, retail stores, warehouses, etc. Security lights are located in areas typically utilized for pedestrian and vehicular traffic, and light these areas so as to render them safer for people and machines. When installed outdoors, these lights must be robust to endure the elements, and reliable to ensure they light when needed. Factors contemplated in the design of security lights must necessarily consider the environment in which the light will be installed and used, the reliability requirements, and service necessity, e.g., frequency and ease of changing light bulbs.

Security lights have typically used incandescent, metal halide or fluorescent light bulbs because of their proven reliability and effectiveness. Recent developments in lighting technology are leading to increased usage of solid-state lighting (SSL), a type of lighting that uses semiconductor light-emitting diodes (LEDs), organic light-emitting diodes (OLED), or polymer light-emitting diodes (PLED) as sources of illumination rather than electrical filaments, plasma (used in arc lamps such as fluorescent lamps), or gas. The term "solid state" refers commonly to light emitted by solid-state electroluminescence, as opposed to incandescent bulbs (which use thermal radiation) or fluorescent tubes. Compared to incandescent, metal halide or fluorescent lighting, SSL creates visible light with reduced heat generation and less energy dissipation.

SSL technology presents many notable advantages over fluorescent, metal halide and fluorescent lighting technologies. A multitude of benefits both in terms of energy savings and environmental savings are associated with SSL technology. SSL's consume less energy (up to 90%) than incandescent bulbs. As a result, they can reduce electricity consumption by 50%, and stay cool to the touch when in use due to their low voltage. LED's last more than twenty times longer than fluorescent or incandescent bulbs, which results in a reduction of maintenance costs and waste materials. In addition, the cycle of turning an SSL on and off has no effect on its life span, while the adverse is true with incandescent lights. Another advantage of SSL is its resistance to vibration and shock, which gives it superior durability.

However, there remains a large embedded base of already-installed lighting fixtures that do not use SSL technology. Because incandescent, metal halide or fluorescent lights have provided inexpensive, good quality lighting, and were quick and easy to replace, they evolved into a standard industry product. They had become the standard light source for a large variety of luminaires, from table lamps, to ceiling mounted fixtures, porch lights, downlights, and desk lamps. A huge infrastructure of lighting fixtures, along with customer knowledge and expectations, was built up over time. That infrastructure developed, at least in part, around an omnidirectional light source that can withstand high-temperature operation, has a standardized electrical interface (Edison base), has a very low purchase price, functions as a simple resistor on electric circuits, and is nearly identical from product to product except for light output. It is therefore only natural that manufacturers developed SSL products to fit into this infrastructure and paradigm.

In order to convert from the older, more expensive and less efficient lights, the existing fixtures must be removed—typically completely removed—and a new light assembly installed that uses SSL technology and devices. It is thus desirable that the replacement assembly comprise the same form factor as the already-installed assembly, to facilitate an easy replacement process. Similarly, connecting power to the new assembly should be simple and easy to perform.

In many SSL security light assemblies, internal brackets, mountings, etc., must be removed during the replacement or installation process, to facilitate mounting and connection of power to the new assembly. Consequently, the installation process can be time-consuming, and more complicated than it need be. It is thus desirable to provide a security light assembly with SSL technology that is easy to install, and that requires little or no disassembly of the new assembly during the installation process.

Thus there exists a need for a solution to the above-identified shortcomings of the prior art.

SUMMARY OF THE INVENTION

The present invention is directed to a security light assembly that overcomes the above-described shortcomings in the art. Specifically, in accordance with an embodiment of the present invention, and as an object of the present invention, a security light assembly is provided that is mountable to a junction box and connectable to a power source via electrical cable routed through the junction box comprises a housing comprising a base and a cover having a lens and a window portion. The cover is removable from the base, the base is attachable to the junction box, and the housing has provided therein a connection for the electrical cable. An access port is defined through the base and through which the electrical cable may pass, the electrical cable being connectable to the connection in the housing. A sub-assembly comprises a first bracket attached to the base, a second bracket attached to the first bracket at a first location and selectively moveable about the first location between at least a first position and at least a second position that is different from the first position, and a solid state light assembly attached to the second bracket and configured to receive power from the power source. When in the first position, the second bracket at least partially obstructs access to the access port, and when in the second position the second bracket does not at least partially obstruct access to the access port to enable connection of the electrical cable to the connection in the housing.

In accordance with an alternative embodiment of the present invention, and as an alternative object of the present invention, a security light assembly is provided that is mountable to a junction box and connectable to a power source via electrical cable routed through the junction box comprises a housing comprising a base and a cover having a lens and a window portion. The cover is removable from the base, the base is attachable to the junction box, and the housing has provided therein a connection for the electrical cable. An access port is defined through the base and through which the electrical cable may pass, the electrical cable being connectable to the connection in the housing. A sub-assembly comprises a first bracket attached to the base, a second bracket attached to the first bracket at a first location and selectively moveable about the first location between at least a first position and at least a second position that is different from the first position. The second bracket is attached to the first bracket at an acute angle and at the first location with a pin, the angle being defined by a plane defined by a top surface of the second bracket and a plane defined by a top surface of the first bracket, and wherein the second bracket is moveable about the first location. The sub-assembly further comprises a solid state light assembly attached to the second bracket and configured to received power from the power source. When in the first position, the second bracket at least partially obstructs access to the access port, and when in the second position the second bracket does not at least partially obstruct access to the access port to enable connection of the electrical cable to the solid state light source.

In accordance with an alternative embodiment of the present invention, and as an alternative object of the present invention, a security light assembly is provided that is mountable to a junction box and connectable to a power source via electrical cable routed through the junction box comprises a housing comprising a base and a cover having a lens and a window portion. The cover is removable from the base, the base is attachable to the junction box, and the housing has provided therein a connection for the electrical cable. An access port is defined through the base and through which the electrical cable may pass, the electrical cable being connectable to the connection in the housing. A sub-assembly comprises a first bracket attached to the base, and a second bracket attached to the first bracket at a first location and selectively moveable about the first location between at least a first position and at least a second position that is different from the first position. The second bracket is attached to the first bracket at the first location with a rivet having an axis defined therethrough, the axis being oriented generally perpendicular to a plane defined by a top surface of the second bracket, and wherein the second bracket is rotationally moveable about the axis. The sub-assembly further comprises a solid state light assembly attached to the second bracket and configured to receive power from the power source. When in the first position, the second bracket at least partially obstructs access to the access port, and when in the second position the second bracket does not at least partially obstruct access to the access port to enable connection of the electrical cable to the connection in the housing.

The security light assembly of the present invention further comprises a first controller connected to the power source and located near the lens, and a second controller connected to the first controller and to the solid state light assembly and configured for controlling the solid state light assembly. The first controller controls a first condition of the second controller. In a preferred embodiment, the first controller is a photo-electric switch configured to detect ambient light outside the housing through the lens, and the first condition of the second controller is one of being on and off, and the second controller is a driver connected to the solid state light assembly and configured for turning the solid state light assembly on and off.

A preferred embodiment further comprises a lock on at least one of the first bracket and second bracket to releasably hold the second bracket in the first position. The lock comprises a stop on one of the first bracket and the second bracket, and a receptacle for receiving the stop and defined in the other one of the second bracket and the first bracket. Preferably, the stop comprises a screw screwed into the first bracket, and the receptacle comprises a cut-out defined in the second bracket to receive the screw.

In one embodiment of the present invention, the second bracket is attached to the first bracket at an acute angle and at the first location with a rivet, the acute angle being defined by a plane defined by a top surface of the second bracket and a plane defined by a top surface of the first bracket, and the second bracket is arcuately moveable about the first location.

In another embodiment of the present invention, the second bracket is attached to the first bracket at the first location with a pin having an axis defined therethrough, the axis being oriented generally perpendicular to a plane defined by a top surface of the second bracket, and wherein the second bracket is moveable about the axis.

In another embodiment of the present invention, the second bracket is attached to the first bracket at the first location with a pin having an axis defined therethrough, the axis being oriented generally parallel to a plane defined by a top surface of the second bracket, and wherein the second bracket is moveable about the axis.

Preferred embodiments of the present invention further comprise a window portion that is one of transparent, translucent and tinted, and a solid state light assembly that comprises a plurality of solid state light devices arranged in an array.

DESCRIPTION OF THE DIAGRAMS

Embodiments of the present invention will now be described with reference to the following diagrams, wherein.

DESCRIPTION OF EMBODIMENTS OF THE INVENTION

Figure 1:
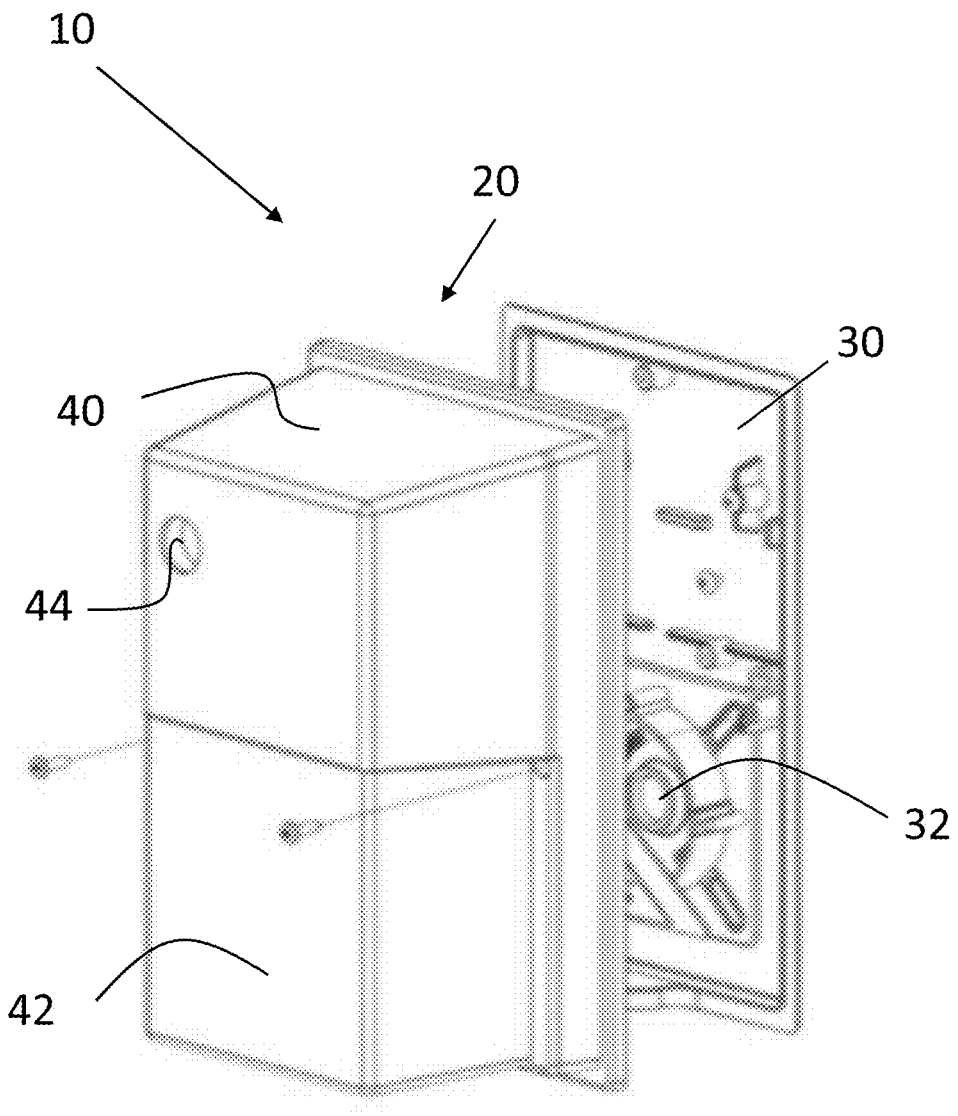
FIG. 1 is a perspective view of a security light assembly in accordance with an embodiment of the present invention.

The present invention will now be described in detail and with reference to the drawing figures. Referring first to FIG. 1, a security light assembly 10 in accordance with an embodiment of the present invention comprises a housing 20 comprised of a base 30 and a cover 40 connectable together by screws, for example. The cover 40 is preferably made of polypropylene, or other similar material, and has a window portion 42 preferably made of polycarbonate with UV stabilizers (to minimize discoloration over time) and that is also shatter resistant. The window portion 42 permits light to exit from the security light assembly 10 and may include features that affect light transmission. For example, the window portion 42 may have a plurality of ribs of varying configurations that will cause light passing through the window portion 42 (and the ribs) to bend, disperse, redirect, diffuse, amplify, or any number of other variations of light transmission. The cover 40 includes a lens 44 through which light may pass and become incident upon a photo-electric switch 62 (described in more detail below). The base 30 of the housing 20 is preferably made of die cast aluminum, and is attachable to a junction box 50 from which electrical cables are routed into the housing 20 to provide power to components of the security light assembly 10.

Figure 2:
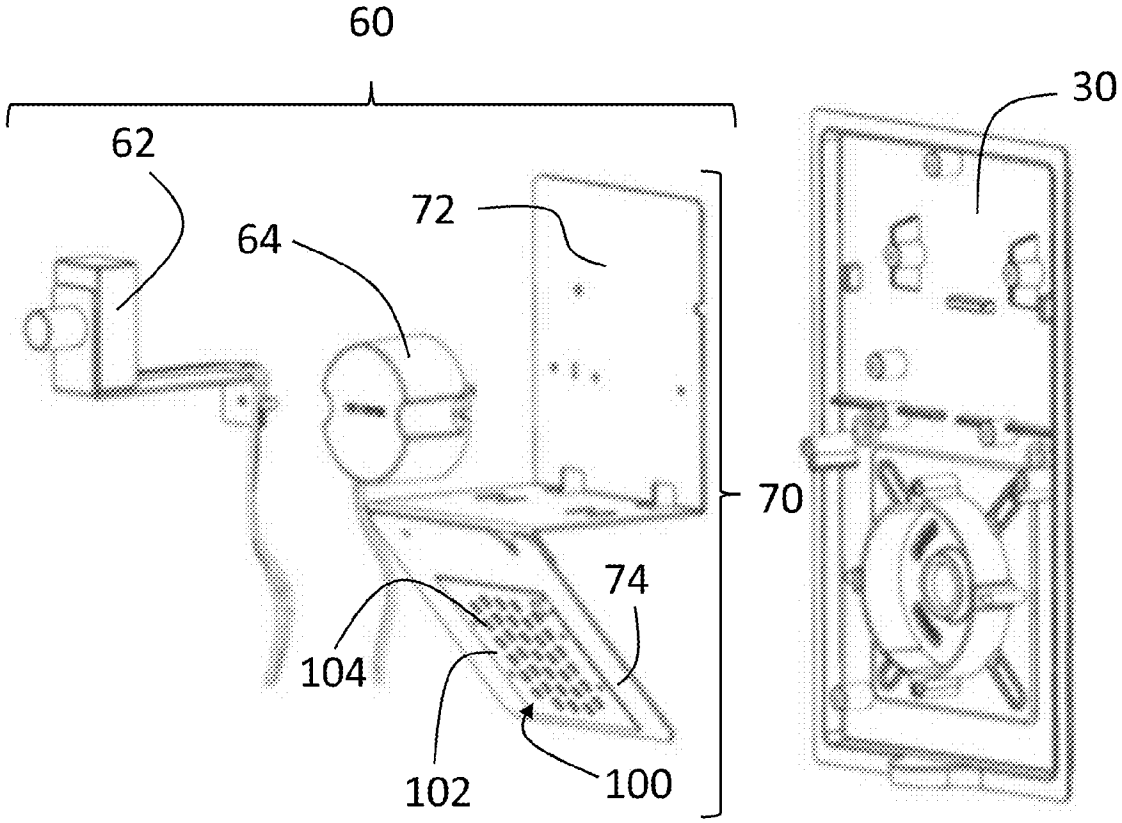
FIG. 2 is an exploded perspective view of components of a security light assembly in accordance with an embodiment of the present invention.
Figure 3:
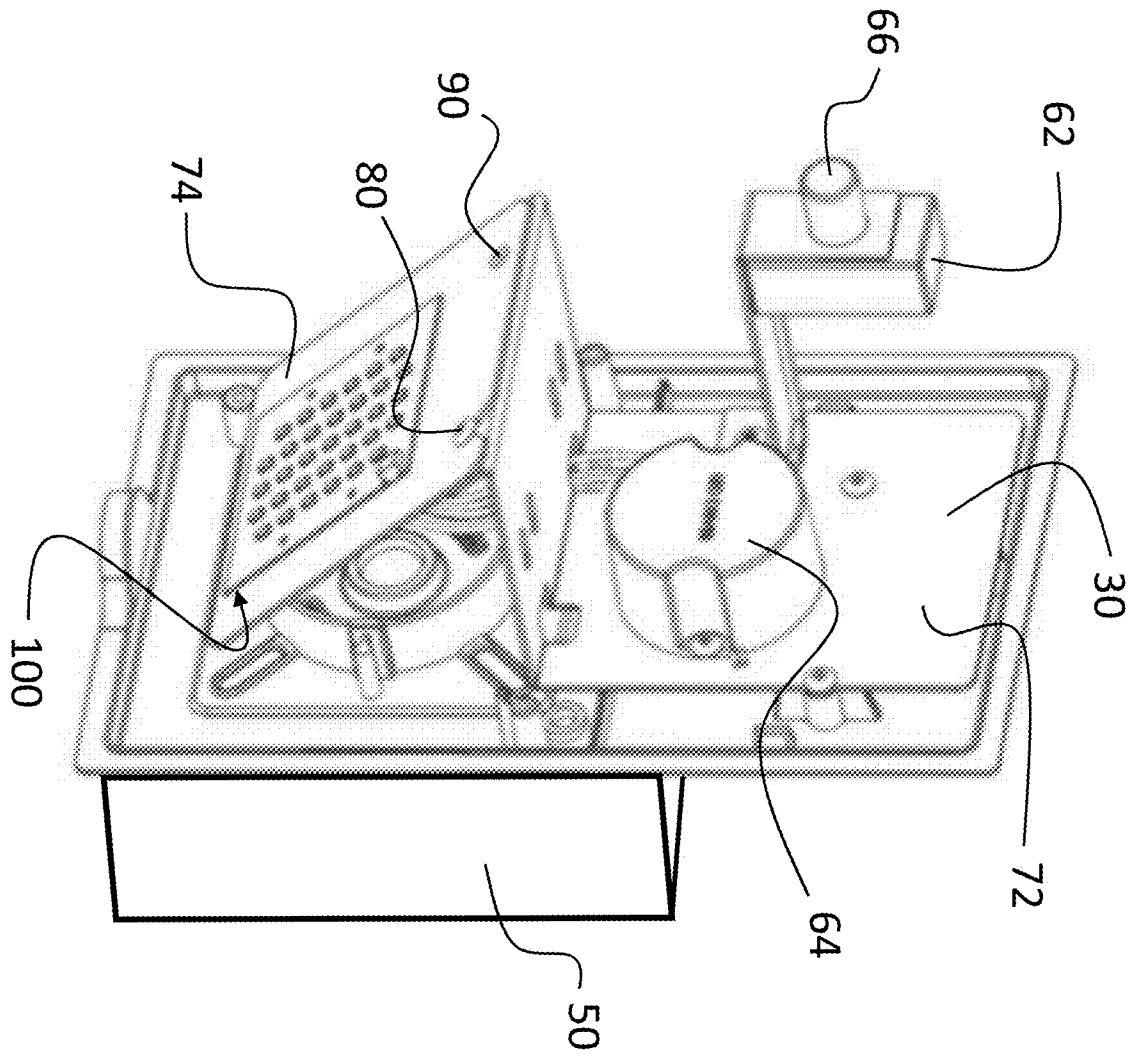
FIG. 3 is a perspective view of a base of a security light assembly and a sub-assembly in accordance with an embodiment of the present invention.

Referring next to FIGS. 2 and 3, the security light assembly 10 further comprises a sub-assembly 60 contained within the housing 20 and attached to the base 30. The sub-assembly 60 comprises a bracket assembly 70 comprised of a first bracket 72 and a second bracket 74, and a solid state light assembly 100 attached to the second bracket 74. The first bracket 72 is attached to the base 30, and the second bracket 74 is attached to the first bracket 72 at a first location 90, preferably by a rivet, or other similar attachment or fastening means. While a rivet is the preferred embodiment, any means of attachment or fastening that facilitates movement of the second bracket 74 in accordance with embodiments of the present invention may also be used.

Figure 5B:
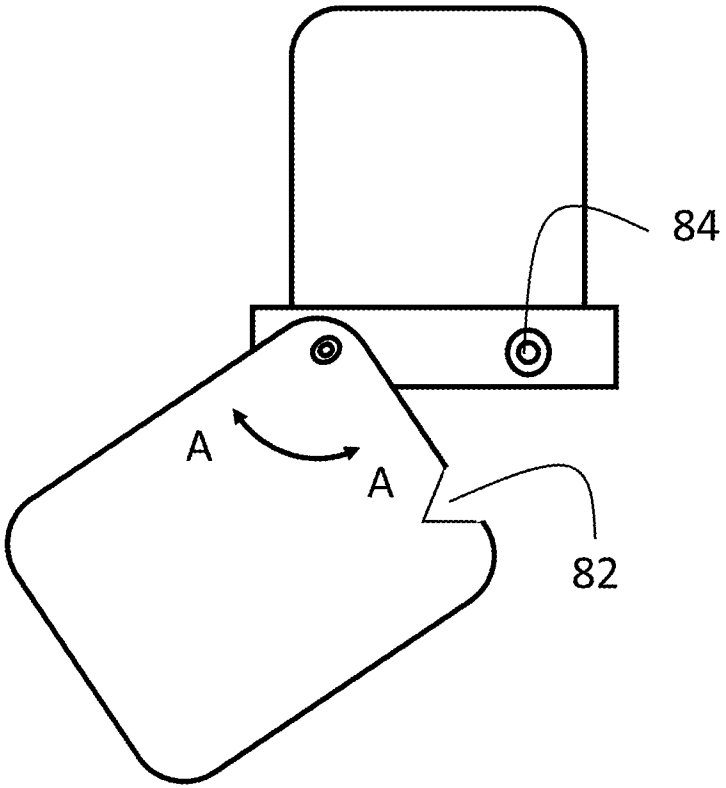
FIGS. 5A and 5B are top views of the second bracket of the present invention movable along the line A-A in accordance with an embodiment of the present invention.
Figure 6A:
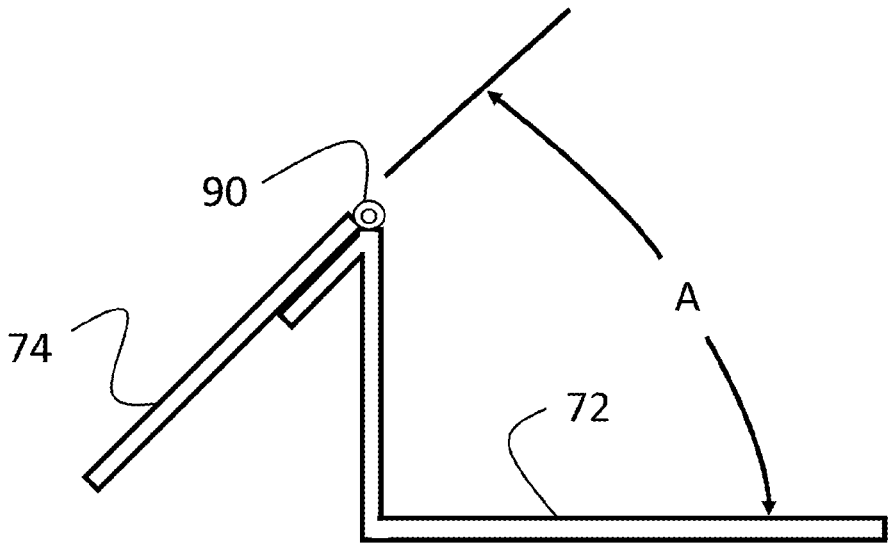
FIGS. 6A and 6B are top views of second bracket of the present invention movable along the line B-B in accordance with an embodiment of the present invention.

In a preferred embodiment, the second bracket 74 attached to the first bracket 72 at an acute angle A and at the first location 90, the angle being defined by a plane defined by a top surface 74' of the second bracket 74 and a plane defined by a top surface 72' of the first bracket 72, as shown in FIG. 6A. The second bracket 74 is moveable about the first location 90 in the direction indicated by arrows A-A shown in FIG. 5B, and arrows B-B shown in FIG. 6B.

In a preferred embodiment, the second bracket 74 is attached to the first bracket 72 at the first location 90 with a rivet having an axis defined therethrough, the axis being oriented generally perpendicular to the plane defined by a top surface 74' of the second bracket 74. In this embodiment, the second bracket 74 is moveable about this axis in the direction indicated by arrows A-A shown in FIG. 5B. Preferably, the second bracket 74 is movable arcuately.

Figure 6B:
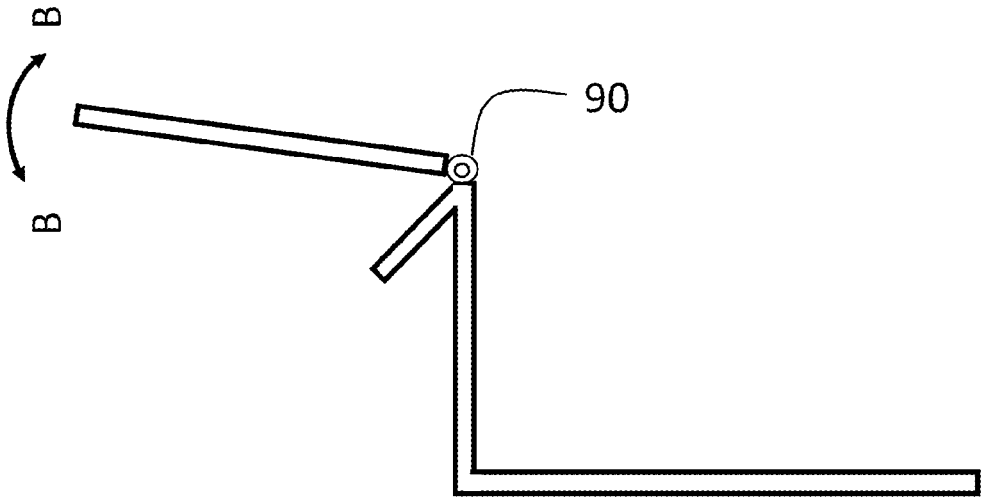

In an alternate embodiment depicted in FIGS. 6A and 6B, second bracket 74 is attached to the first bracket 72 at the first location 90 with a pin having an axis defined therethrough, the axis being oriented generally parallel with a plane defined by a top surface 74' of the second bracket 74, with the second bracket 74 being moveable about this axis in the direction indicated by arrows B-B. Preferably, the second bracket 74 is movable arcuately.

Figure 5A:
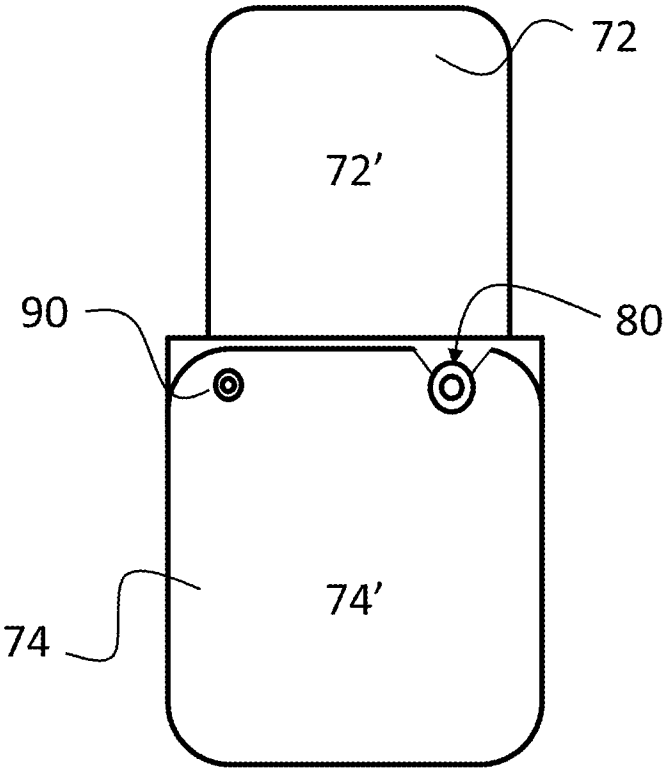

The second bracket 74 is selectively moveable about the first location 90 between at least a first position shown in FIG. 5A or FIG. 6A, in which the second bracket 74 at least partially obstructs access to the access port 32, and a second position shown in FIG. 5B or FIG. 6B, in which the second bracket 74 does not at least partially obstruct access to the access port 32.

Figure 4:
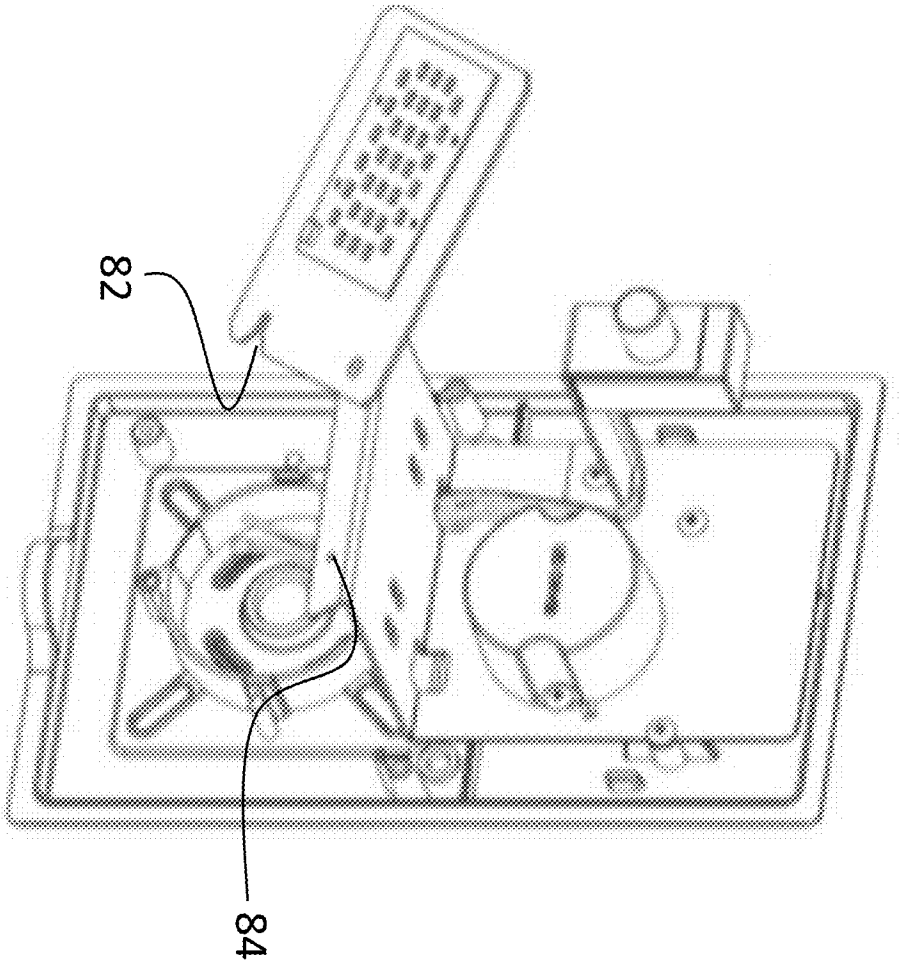
FIG. 4 is a perspective view of a base of a security light assembly and a sub-assembly in accordance with an embodiment of the present invention.

Referring next to FIG. 4, a lock 80 is provided to releasably secure the second bracket 74 in the first position. The lock 80 comprises a first part on one of the first bracket 72 and second bracket 72, and a second part on the other one of the first bracket 72 and second bracket 74. In a preferred embodiment, the lock 80 comprises a screw 84 screwed into a hole in the first bracket 72, and a stop 82 defined in the second bracket 74. The stop further preferably comprises a receptacle 82 defined in the second bracket 74 to receive the screw 84. When the second bracket 74 is in the first position (see, e.g., FIG. 5A), the screw 84 may be tightened so as to engage the second bracket 74 and secure it in the first position. The screw 84 may be selectively loosened to release the second bracket 74 so as to permit movement thereof out of and back into the first position. While a screw 84 and receptacle 82 are disclosed as a preferred embodiment, the present invention contemplates other structure and means that function in a manner to releasably secure the second bracket 74 in the first position, such other structure and means being within the scope and spirit of the present invention.

With continued reference to FIGS. 2 and 3, a solid state light assembly 100 is mounted to the second bracket 74 and includes a printed circuit board 102 and a plurality of solid state light (SSL) devices 104 such as, by way of non-limiting example, light emitting diodes (LED). The SSL devices 104 are preferably arranged in an array.

The sub-assembly 60 also includes a photo-electric switch 62 attached to the first bracket 72 and positioned so that light entering the housing 20 through the lens 44 is incident upon the photovoltaic element 66 of the switch 62, so as to produce an electric signal in response to changes in ambient light outside the housing 20. The photo-electric switch 62 is connected to a power source (e.g., 110/220 VAC) for the security light assembly 10. The photo-electric switch 62 detects ambient light conditions outside of the housing 20, and generates a control signal to a driver 64 of the SSL devices 104 that turns the devices 104 on and off depending upon whether it is light or dark outside. Responsive to the control signal from the photo-electric switch 62, the driver 64 supplies DC power to the SSL devices 104, preferably in the range of 37V DC, and current around 315 mA.

Referring next to FIGS. 4-6, the security light assembly 10 of the present invention will be discussed in greater detail. Power for the security light assembly 10 is from connection to an external power source such has, for example, a conventional AC power source (e.g., 110/220 VAC, 115/230 AC, etc.). Power is provided to the security light assembly 10 via one or more cables from the junction box 50 (see, e.g., FIG. 3), and that enter the housing 20 through an aperture or access port 32 defined in the base 30 of the housing 20.

In a typical usage situation, the security light assembly 10 of the present invention will replace an existing security light assembly, typically one that utilizes a less efficient and costly light source such as, for example, incandescent, metal halide or fluorescent (including compact fluorescent or CFL) lights. To simplify such replacements, the new security light assembly, such as one in accordance with the present invention, is preferably a direct substitution for the existing assembly, with no re-wiring or other modifications required. Replacement thus entails disconnecting the electrical wiring from an existing security light assembly and removing it from the junction box 50, attaching a security light assembly 10 in accordance with embodiments of the present invention to the junction box 50 and reconnecting the electrical wiring to provide power to the new security light assembly 10.

The configuration of components inside the security light assembly 10 of the present invention, as well as other know security light assemblies, results in at least partial obstruction of the access port 32 through which electric cable providing power to the assembly is routed. For known security light assemblies, disassembly and/or removal of some or all of the components is required in order to access the access port. In accordance with embodiments of the present invention, access to the access port 32 is easily facilitated by movement of the second bracket 74 from the first position (see, e.g., FIGS. 5A and 6A) to the second position (see, e.g., FIGS. 5B and 6B), thereby providing easy access to the access port 32 without having to disassemble or remove parts or components inside the housing 20. This facilitates routing the electrical cable into the housing 20 and connecting it to the security light assembly 10. By loosening screw 84, the second bracket 74 is movable out of the first position along the lines A-A shown in FIG. 5B, thereby providing access to the access port 32. Routing the electric cable and connecting it are possible without disassembly and/or removal of any components of the security light assembly 10. Similarly, the second bracket 74 may be moved along the lines B-B shown in FIG. 6B to likewise move the second bracket 74 out of the first position and provide easy access to the access port 32.

Modifications to embodiments of the present invention are possible without departing from the scope of the invention as defined by the accompanying claims. Expressions such as "including," "comprising," "incorporating," "consisting of," "have," "is," used to describe and claim the present invention are intended to be construed in a non-exclusive manner, namely allowing for items, components or elements not explicitly described herein also to be present. Reference to the singular is to be construed to relate to the plural, where applicable.

What is claimed is:

1. A security light assembly mountable to a junction box and connectable to a power source via electrical cable routed through the junction box, the light assembly comprising:

a housing comprising a base and a cover having a lens and a window portion, the cover being removable from the base, and the base being attachable to the junction box, the housing having provided therein a connection for the electrical cable;

an access port defined through the base and through which the electrical cable may pass, the electrical cable being connectable to the connection in the housing;

a sub-assembly comprising:

a first bracket attached to the base;

a second bracket attached to the first bracket at a first location and selectively moveable about the first location between at least a first position and at least a second position that is different from the first position, wherein the second bracket is attached to the first bracket at an acute angle and at the first location with a rivet, the acute angle being defined between a first plane defined by a top surface of the second bracket and a second plane defined by a top surface of the first bracket, and wherein the second bracket is arcuately moveable about the first location;

a solid state light assembly attached to the second bracket and configured to receive power from the power source;

wherein, when in the first position the second bracket at least partially obstructs access to the access port, and when in the second position the second bracket does not at least partially obstruct access to the access port to enable connection of the electrical cable to the connection in the housing.

2. The security light assembly of claim 1, further comprising:

a first controller connected to the power source and located near the lens; and a second controller connected to the first controller and to the solid state light assembly and configured for controlling the solid state light assembly;

wherein the first controller controls a first condition of the second controller.

3. The security light assembly of claim 2, wherein the first controller is a photo-electric switch configured to detect ambient light outside the housing through the lens, and wherein the first condition of the second controller is one of being on and off.

4. The security light assembly of claim 2, wherein the second controller is a driver connected to the solid state light assembly and configured for turning the solid state light assembly on and off.

5. The security light assembly of claim 1, further comprising a lock on at least one of the first bracket and second bracket to releasably hold the second bracket in the first position.

6. The security light assembly of claim 5, wherein the lock comprises a stop on one of the first bracket and the second bracket, and a receptacle for receiving the stop and defined in the other one of the second bracket and the first bracket.

7. The security light assembly of claim 6, wherein the stop comprises a screw screwed into the first bracket, and wherein the receptacle comprises a cut-out defined in the second bracket to receive the screw.

8. The security light assembly of claim 1, wherein the window portion is one of transparent, translucent and tinted.

9. The security light assembly of claim 1, wherein the solid state light assembly comprises a plurality of solid state light devices arranged in an array.

10. A security light assembly mountable to a junction box and connectable to a power source via electrical cable routed through the junction box, the light assembly comprising:

a housing comprising a base and a cover having a window portion, the cover being removable from the base, and the base being attachable to the junction box, the housing having provided therein a connection for the electrical cable;

an access port defined through the base and through which the electrical cable may pass, the electrical cable being connectable to the connection in the housing;

a sub-assembly comprising:

a first bracket attached to the base;

a second bracket attached to the first bracket at a first location and selectively moveable about the first location between at least a first position and at least a second position that is different from the first position, wherein the second bracket is attached to the first bracket at an acute angle and at the first location with a pin, the acute angle being defined between a first plane defined by a top surface of the second bracket and a second plane defined by a top surface of the first bracket, and wherein the second bracket is moveable about the first location;

a solid state light assembly attached to the second bracket and configured to received power from the power source;

wherein, when in the first position the second bracket at least partially obstructs access to the access port, and when in the second position the second bracket does not at least partially obstruct access to the access port to enable connection of the electrical cable to the solid state light source.

11. The security light assembly of claim 10, further comprising:

a first controller connected to the power source and located near the lens; and a second controller connected to the first controller and to the solid state light assembly and configured for controlling the solid state light assembly;

wherein the first controller controls a first condition of the second controller.

12. The security light assembly of claim 11, wherein the first controller is a photo-electric switch configured to detect ambient light outside the housing through the lens, and wherein the first condition of the second controller is one of being on and off.

13. The security light assembly of claim 11, wherein the second controller is a driver connected to the solid state light assembly and configured for turning the solid state light assembly on and off.

14. The security light assembly of claim 10, further comprising a lock on at least one of the first bracket and second bracket to releasably hold the second bracket in the first position.

15. The security light assembly of claim 14, wherein the lock comprises a stop on one of the first bracket and the second bracket, and a receptacle for receiving the stop and defined in the other one of the second bracket and the first bracket.

16. The security light assembly of claim 15, wherein the stop comprises a screw screwed into the first bracket, and wherein the receptacle comprises a cut-out defined in the second bracket to receive the screw.

17. The security light assembly of claim 10, wherein the pin having an axis defined therethrough, the axis being oriented generally perpendicular to the first plane defined by the top surface of the second bracket, and wherein the second bracket is moveable about the axis.

18. The security light assembly of claim 10, wherein the pin having an axis defined therethrough, the axis being oriented generally parallel to the first plane defined by the top surface of the second bracket, and wherein the second bracket is moveable about the axis.

19. The security light assembly of claim 10, wherein the window portion is one of transparent, translucent and tinted.

20. The security light assembly of claim 10, wherein the solid state light assembly comprises a plurality of solid state light devices arranged in an array.

* * * * *